United States Patent [19]

Lan

[11] Patent Number: 4,733,858

[45] Date of Patent: Mar. 29, 1988

[54] MULTI-PURPOSE EXERCISER

[76] Inventor: Chuang S. Lan, No. 66, Lane 244, Shin Shu Rd., Shin Juang Shyh, Taipei Hsien, Taiwan

[21] Appl. No.: 866,205

[22] Filed: May 23, 1986

[51] Int. Cl.[4] ..... A63B 21/00

[52] U.S. Cl. ..... 272/70; 272/97; 272/130; 272/DIG. 4

[58] Field of Search ..... 272/69, 70, 130, DIG. 4, 272/134, 97; 198/861.1, 861.2, 861.4

[56] References Cited

U.S. PATENT DOCUMENTS

| | | | |
|---|---|---|---|
| 2,117,957 | 5/1938 | Heller | 272/69 |
| 3,892,404 | 7/1975 | Martucci | 272/134 |
| 3,970,302 | 7/1976 | McFee | 272/130 |
| 4,383,684 | 5/1983 | Schliep | 272/134 X |
| 4,496,147 | 1/1985 | De Cloux et al. | 272/130 |

*Primary Examiner*—Richard J. Apley
*Assistant Examiner*—J. Welsh
*Attorney, Agent, or Firm*—Lowe, Price, LeBlanc, Becker & Shur

[57] ABSTRACT

This invention relates to a multi-purpose exerciser and in particular to one utilizing a throttling valve for presenting a selectable number of operable speeds to the user. The exerciser mainly includes two racks, a controlling button, a cross rod, an upright stand, a base, two contractible rods, two frames and a supporting rod stand, whereby it can be used to exercise rowing, climbing, skating etc. The force required to operate the pedals of the exerciser is established by the throttling valve which controls the rate of oil passing through a pair of rubber tubes into cylinders housing pistons driven by the pedals.

2 Claims, 14 Drawing Figures

MULTI-PURPOSE EXERCISER

BACKGROUND OF THE INVENTION

The importance of regular exercise is widely appreciated for reasons ranging from the need to control weight to programs for those recovering from heart ailments.

While the type and extent of the exercise individuals practice often depends on a physician's recommendations, it is recognized that exercise should not only be regular but also sufficiently strenuous to cause the heart beat to be accelerated for a reasonable but substantial interval.

For many, exercise outdoors is preferred with jogging popular while others enjoy brisk walks. For others, however, weather conditions and the character of the neighborhood make exercise indoors preferable although it is then usually necessary to use a captive bicycle or a treadmill exerciser.

Such devices, however, are monotonous to use as a consequence of which, interest in an exercise program is often lost so that what is needed is a way to make the use of such devices a pleasurable interval with the exercise automatically taking place.

It is, therefore, an object of the present invention to provide an exerciser which may obviate and mitigate the above-mentioned drawbacks.

SUMMARY

This invention relates to a multi-purpose exerciser.

It is the primary object of the present invention to provide a multi-purpose exerciser which utilizes a throttling valve for presenting a selectable number of operable speeds to the user.

It is another object of the present invention to provide a multi-purpose exerciser which can be operated by a wide range of users of various strength capabilities.

It is still another object of the present invention to provide a multi-purpose exerciser which is easy to operate.

It is still another object of the present invention to provide a multi-purpose exerciser which is economic to produce.

It is a further object of the present invention to provide a multi-purpose exerciser which is facile to manufacture.

Other objects and merits and a fuller understanding of the present invention will be obtained by those having ordinary skill in the art when the following detailed description of the preferred embodiment contemplated for practicing the best mode of the invention has been read in conjunction with the accompanying drawings wherein like numerals refer to like or similar parts and in which:

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
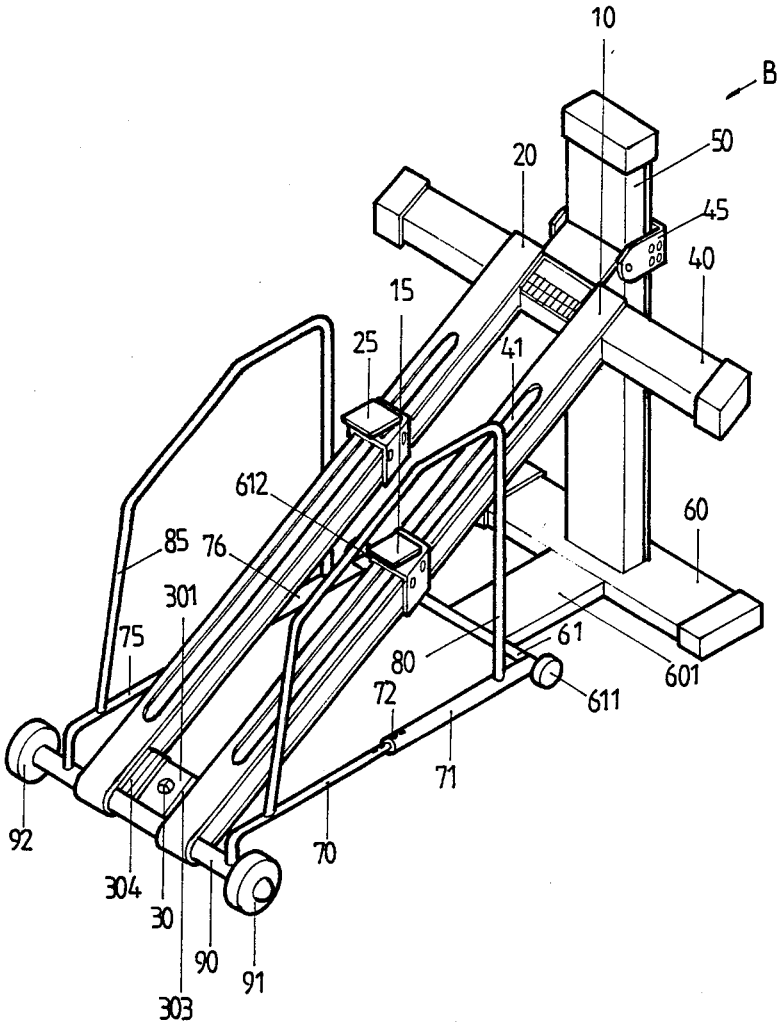
FIG. 1 is a perspective view of a multi-purpose exerciser according to the present invention.
Figure 10:
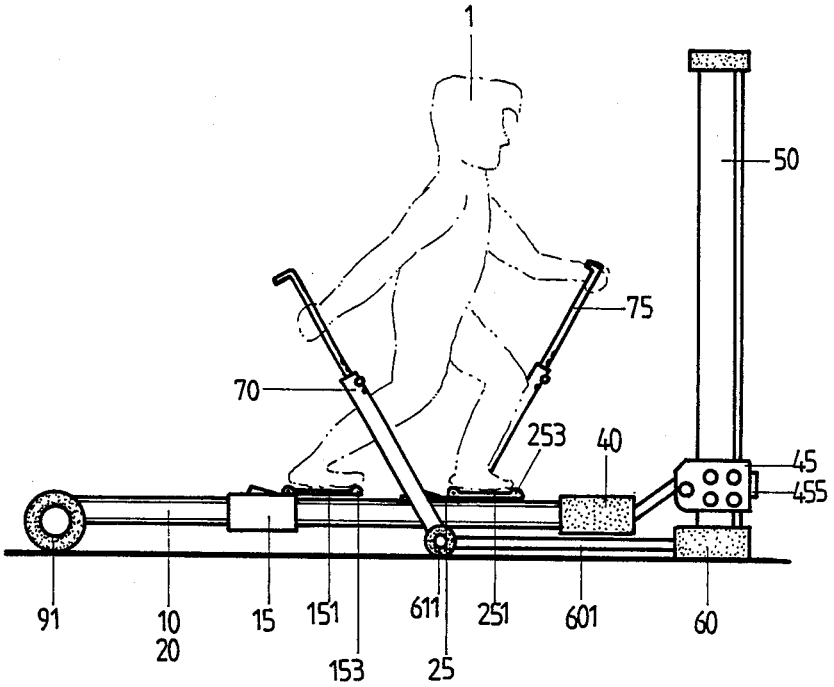
FIG. 10 shows a second application of the multi-purpose exerciser.

With reference to the drawings and in particular to FIG. 1 thereof, the multi-purpose exerciser according to the present invention mainly comprises two racks 10 and 20, a controlling button 30, a cross rod 40, an upright stand 50, a base 60, two contractible rods 70 and 75, two frames 80 and 85, and a supporting rod 90. The front ends of the racks 10 and 20 are fixed on the cross rod 40 which is provided with a dashboard 41 at the middle for showing the rate of energy consumption. The cross rod 40 is fixed on the upright stand 50 by an adjusting bracket 45. The upright stand 50 is rigidly mounted on the lower stand 60. The lower stand 60 is connected to the lower rod 90 via two contractible rods 70 and 75 on which are respectively mounted two frames 80. The lower ends of the racks 10 and 20 are rotatably connected with the supporting rod 90. As a result, the angle of inclination of the racks 10 and 20 will change when the adjusting bracket 45 is moved along the upright stand 50. The front ends of the two contractible rods 70 and 75 are respectively rigidly joined to two sleeves 71 and 76 enclosing a rear rod 61. The two contractible rods 70 and 75 are merely inserted into the supporting rod 90 and can be taken up as shown in FIG. 10. The contractible rods 70 and 75 are composed of two rods respectively united together by two screws 72 and 77 (not shown).

Figure 2:
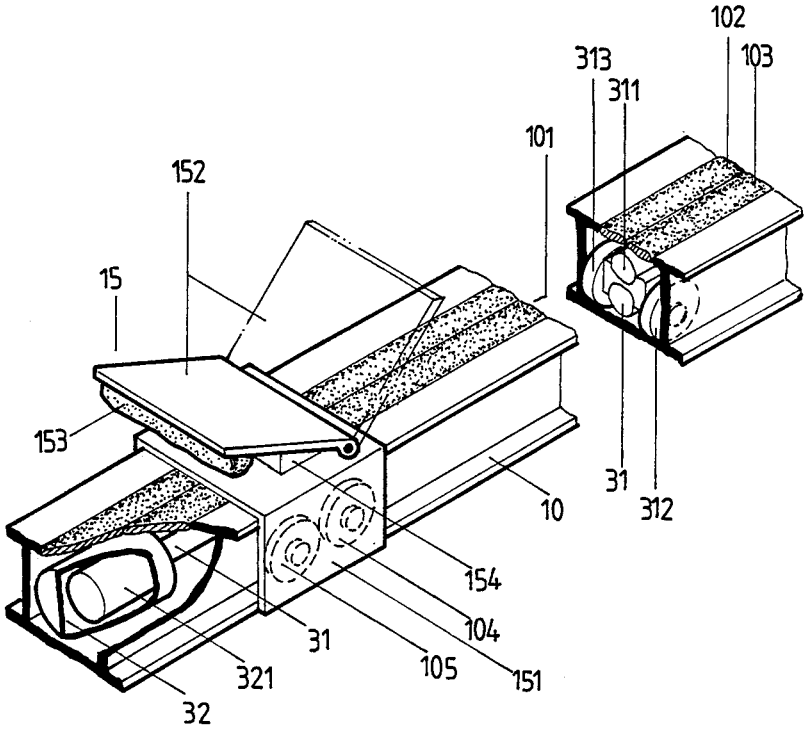
FIG. 2 is a fragmentary view showing structure of the rack of the multi-purpose exerciser.
Figure 3:
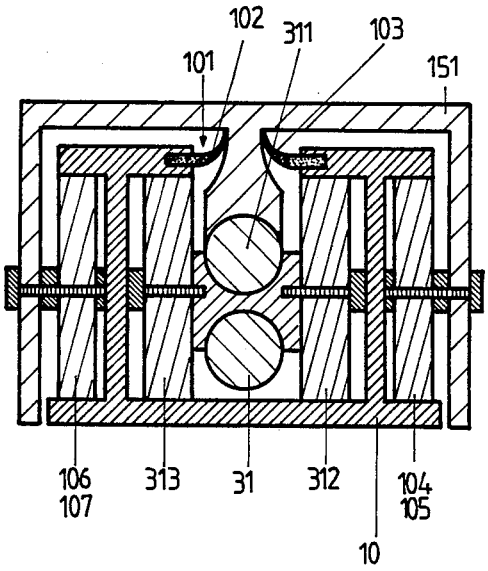
FIG. 3 is a cross-sectional view taken along line A—A of FIG. 2.

Referring to FIG. 2, there is shown the structure of the rack 10. The racks 10 and 20 are the same in structure and so only one of them is shown for illustration. As illustrated the rack 10 is formed with a slot 101 covered with two rubber pads 102 and 103 for keeping away dust. Mounted on the rack 10 is a pedal 15 which has a base plate 151, a riding plate pivoted thereon, a stopper 154 formed on the base plate 151 and a holding means 153 attached to the bottom surface of the riding plate. The pedal 15 is slidably mounted on the rack 10 by means of four rollers 104, 105, 106, and 107 (see FIG. 3). The inner side of the base plate 151 is rigidly attached to the front end of a sliding rod 31. Two rollers 312 and 313 are respectively mounted at two sides of the sliding rod 31. The sliding rod 31 is fixedly connected to piston 321 of a cylinder 32. An extension rod 311 is welded or otherwise joined to the sliding rod 31. Consequently, the pedal 15 can be moved along a distance equal to the throw of the sliding rods as the piston 321 is traversed by pedal 15 within the cylinder 32.

Figure 4:
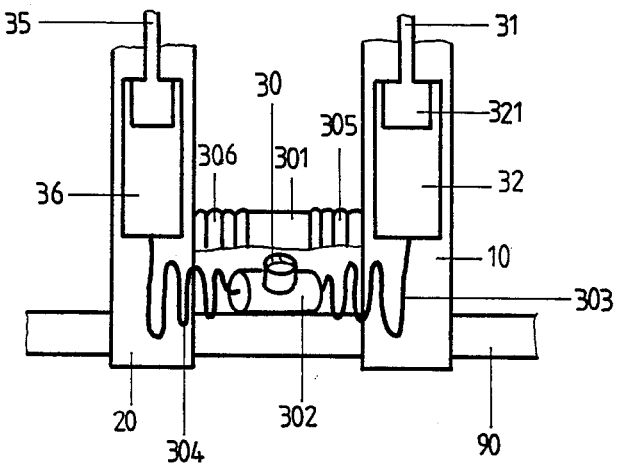
FIG. 4 shows the oil passage of the multi-purpose exerciser.
Figure 5:
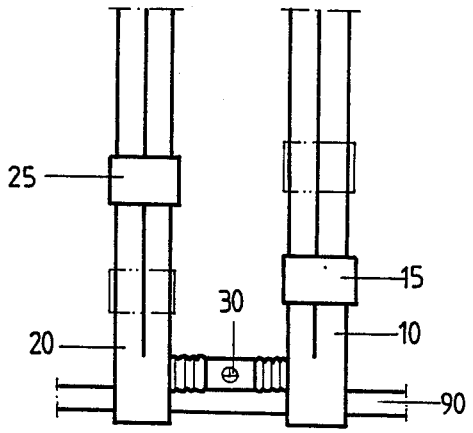
FIG. 5 shows the motion of the sliding block of the multi-purpose exerciser.

As shown in FIGS. 4 and 5, the housing 301 of the controlling button 30 is fixed on the lower rod 90. Inside the housing 301 there is a throttling valve 302 having two rubber tubes 303 and 304 respectively connected to two sides thereof. Two contractible enveloping means 305 and 306 are respectively mounted between the racks 10 and 20 and the housing 301. The rubber tubes 303 and 304 are connected to two cylinders 32 and 36 respectively having two sliding rod 31 and 35. Since the two cylinders 32 and 36 are connected by rubber tubes 303 and 304 and the throttling valve 302, the sliding rod 35 will be lifted upward when the sliding rod 31 is moved downward. Thus, the pedals 15 and 25 can be moved with respect to each other. The throttling valve 302 is designed to control the rate of oil passing therethrough thereby presenting a selectable number operable speeds to the user.

Figure 6:
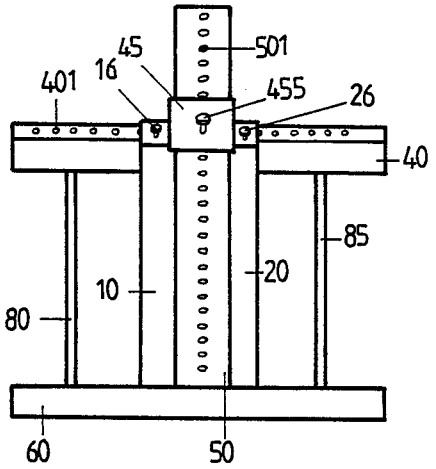
FIG. 6 is a rear view taken from arrow B of FIG. 1.
Figure 7:
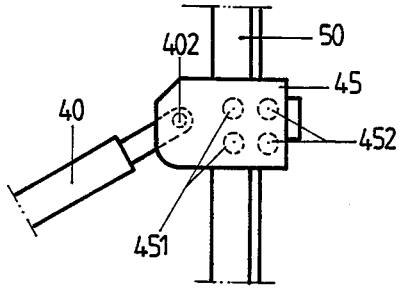
FIG. 7 is an enlarged fragmentary view showing the connection of the cross bar and the adjusting bracket.
Figure 8:
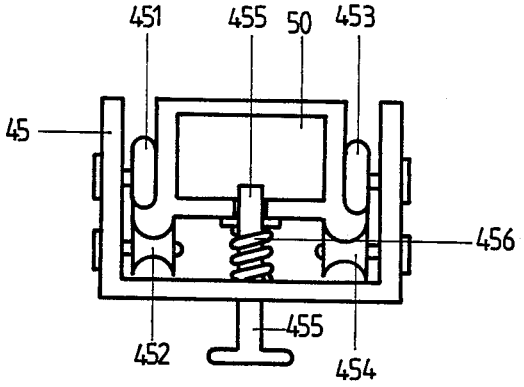
FIG. 8 shows the structure of the adjusting bracket.

With reference now to FIG. 6, the cross rod 40 is formed with a plurality of holes 401 on the rear side thereof. The front ends of the racks 10 and 20 is respectively provided with a bolt 16 for regulating the distance between the two racks 10 and 20. The cross rod 40 is pivoted to the adjusting bracket 45 by a pin 402. The adjusting bracket 45 is provided with four rollers 451, 452, 453 and 454 so that it can be easily moved along the upright stand 50. The upright stand 50 has a plurality of holes 501 whereby the adjusting bracket 45 can be fixed in position by engaging a bolt 455 therewith. A spring 456 is disposed with the adjusting bracket 45 and the upright stand 50 so as to enable the bolt 455 to return to its original position.

Figure 9:
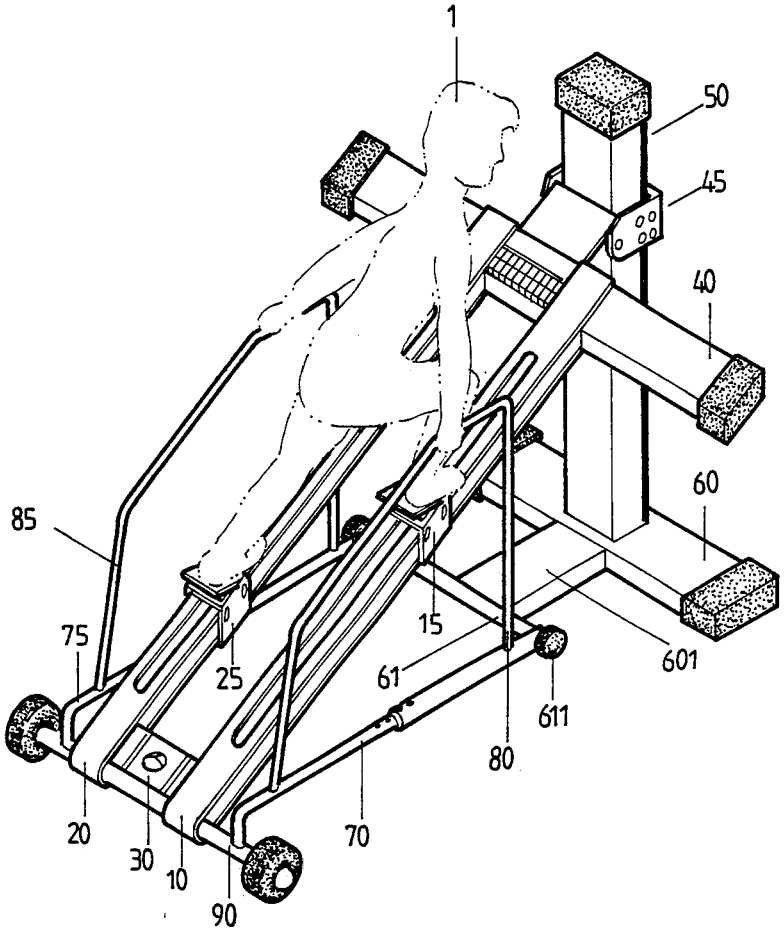
FIG. 9 shows a first application of the multi-purpose exerciser.

As illustrated in FIG. 9, the upright stand 50 is rigidly mounted on the lower stand 60. The lower stand 60 is formed with an extension base 601 joined to a supporting rod 61. Two ends of the rear rod 61 are provided with two rollers 611 and 612, respectively.

As may be seen in FIGS. 1 and 5, the multi-purpose exerciser can enable the user to practice climbing.

Furthermore, the present invention can be used to practice skating by lowering the two racks 10 and 20, then dismantling the frames 80 and 85 and turning up the contractible rods 70 and 75 (see FIG. 10).

Figure 11:
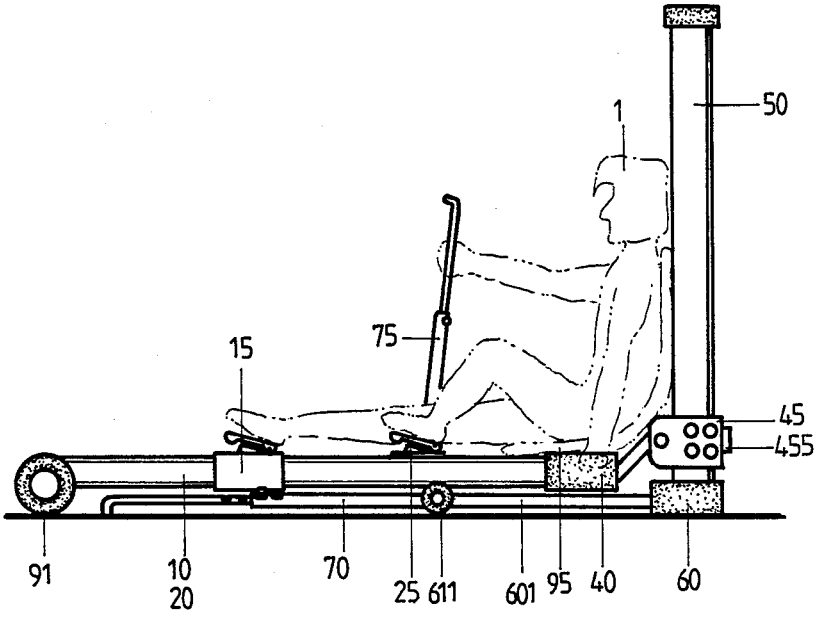
FIG. 11 shows a third application of the multi-purpose exerciser.

FIG. 11 shows a third application of the present invention. As shown, the user can sit on a cushion 95, with his feet operating the pedals 25 so that he can fully exercise his foot muscles.

Figure 12:
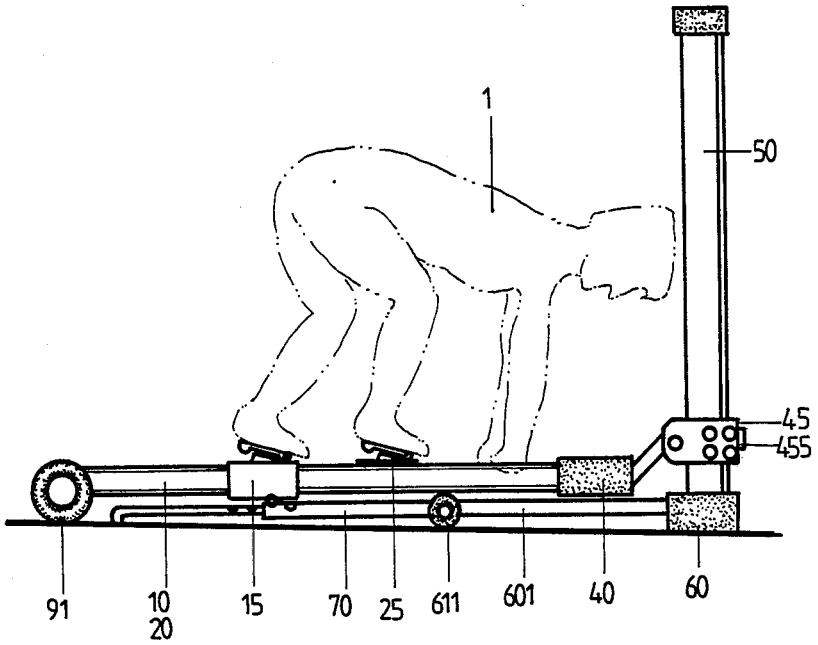
FIG. 12 shows a fourth application of the multi-purpose exerciser.

FIG. 12 shows a fourth application of the present invention. The frames 80 and 85 are first removed and then the racks 10 and 20 are lowered. The user grasps the racks 10 and 20 with his two hands and operate the pedals 15 and 25 with both feet.

Figure 13:
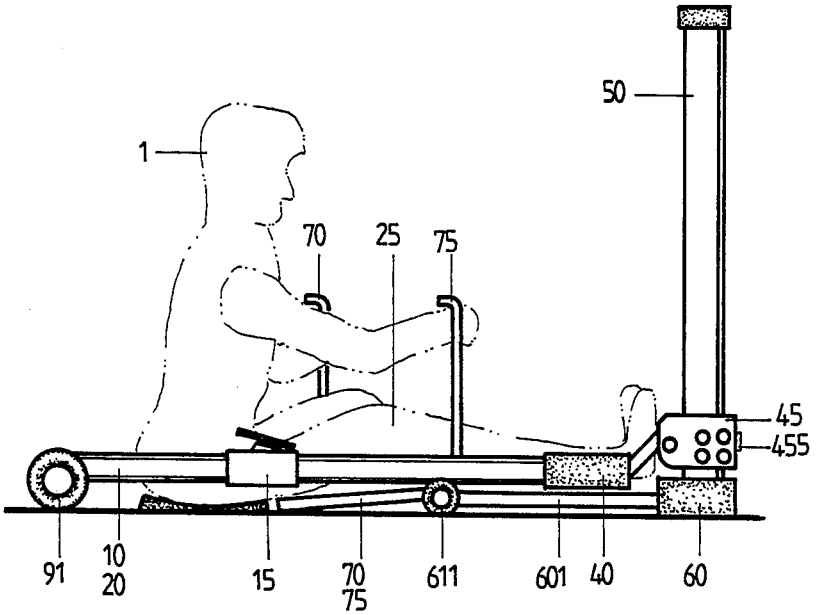
FIG. 13 shows a fifth application of the multi-purpose exerciser.
Figure 14:
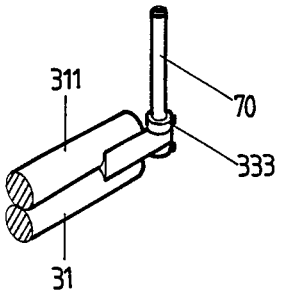
FIG. 14 shows how to connect the contractible rod to the sliding rod.

FIG. 13 shows a fifth application of the present invention. In use, first adjust the distance between the two racks 10 and 20 so that the user may sit thereon. Then, remove the contractible rods 70 and 75 and insert them into respective one of the racks 10 and 20 so that they are fixedly connected with corresponding sleeves 333 and 334 which are welded or otherwise joined to the extension rods 311 and 312. As a result, the present invention can also be used as a rowing exerciser.

Other embodiments and modifications will occur to those skilled in the art. No attempts has been made to illustrate all possible embodiments of the invention, but rather intended such alternations and further modifications in the illustrated device, and such further applications as illustrated herein being contemplated as would normally occur to one skilled in the art to which the invention relates.

I claim:

1. A multi-purpose exerciser comprising:

a base;

an upright stand fixedly mounted on said base; a pair of contractible rods connected at one end to said base and at the other end to a supporting rod;

an adjusting bracket slidably mounted on said upright stand;

a cross rod connected with said adjusting bracket;

two racks slidably connected at one end with said cross rod and at the other end with said supporting rod;

two frames respectively mounted on said two contractible rods;

two cylinders respectively disposed within said two racks, each said cylinder having a piston connected with a sliding rod; and a throttling valve connecting said two cylinders;

two pedals respectively mounted on said two racks and rigidly connected with said sliding rods.

2. A multi-purpose exerciser as claimed in claim 1, further comprising rollers disposed between said pedals and said racks.

* * * * *